United States Patent [19]

Eiermann

[11] Patent Number: 4,487,561

[45] Date of Patent: Dec. 11, 1984

[54] ROTARY PISTON COMPRESSOR

[75] Inventor: Dankwart Eiermann, Lindau, Fed. Rep. of Germany

[73] Assignee: Wankel GmbH, Berlin, Fed. Rep. of Germany

[21] Appl. No.: 431,646

[22] Filed: Sep. 30, 1982

[30] Foreign Application Priority Data

Apr. 2, 1981 [DE] Fed. Rep. of Germany ..... 3113233

[51] Int. Cl.[3] ..... F04C 18/22

[52] U.S. Cl. ..... 418/61 A

[58] Field of Search ..... 418/61 A, 124, 120, 418/121, 189, 77, 79, 75

[56] References Cited

U.S. PATENT DOCUMENTS

| | | | |
|---|---|---|---|
| 3,185,387 | 5/1965 | Paschke | 418/61 A |
| 3,405,695 | 10/1968 | Jones et al. | 418/61 A |
| 4,150,926 | 4/1979 | Eiermann | 418/61 A |

*Primary Examiner*—John J. Vrablik
*Assistant Examiner*—John J. McGlew, Jr.
*Attorney, Agent, or Firm*—Becker & Becker, Inc.

[57] ABSTRACT

A rotary piston compressor with a dual-arc trochoidal casing surface runway or path. The corners of a piston having three flanks or sides and rotating on an eccentric of an eccentric shaft are provided with radial sealing strips which are in continuous sliding contact with the runway. Overflow or transfer recesses are provided in a housing via which the already closed-off following or trailing working chamber, which is created in the region of the dead center position, is connected briefly with the preceding compression chamber. The leading corners of each of three flanks of the piston are bevelled or chamfered radially inwardly and toward the grooves of the radial sealing strips. The leading corners of each of the three flanks of the piston are cut off in planes which intersect in a straight line that lies in the radial central plane of the piston externally of the piston, and at right angles to a straight line which extends in the radial central plane of the piston through the axis of rotation of the piston, and through the sealing strip, which passes through the planes.

2 Claims, 7 Drawing Figures

ROTARY PISTON COMPRESSOR

The present invention relates to a rotary piston compressor with a dual-arc trochoidal housing or casing surface runway or path; the corners of a piston having three flanks and rotating on an eccentric of an eccentric shaft are provided with radial sealing strips which are in continuous sliding contact with the runway. Overflow or transfer recesses are provided in a housing via which the already closed-off following or trailing working chamber, which is created in the region of the dead center position, is briefly connected with the compression chamber preceding it.

BACKGROUND OF THE INVENTION

1. Field of the Invention

Such overflow or transfer recesses, the position of which is determined by the leading piston corner in a working chamber created in the dead center position, have the purpose to relieve the gas pressure, which still exists in the chamber created in the dead center position after closing the discharge or outlet, to the leading or preceding chamber which is created at the beginning of the compression cycle, and thus to avoid the negative torque otherwise caused by this remaining pressure during further rotation of the piston beyond its dead center position.

2. Description of the Prior Art

The overflow recesses can, as shown in German Offenlegungsschrift No. 21 57 546, be radial channels deepened into the surface path or runway and extending in direction of rotation of the piston, between which channels the surface of the mantle path or runway remains as webs or at the edge of which the same remains as side strips in order to prevent the radial sealing strips from dropping into these channels. It has been found, however, that in operation the path or runway surface of these webs and side strips can be destroyed in a short time by beating-in of the sealing strips.

The reasons for the foregoing can be found in a canting or tilting of the radial sealing strips, which as a consequence of elimination of the pressure in the following chamber during approaching of the overflow recess are tilted by recess gas pressure existing again, and by the friction of the radial sealing strips against the surface raceway or path; this traps the recess gas in the recess, and prevents the release or relieving thereof. The strip is therefore beaten by the groove gas, accompanied by a hammering noise, against the webs and edge strips of the surface runway or path. The braking effect thereby exerted upon the piston additionally leads to a beating of the gearing. The beating or striking of the tilted and consequently jammed strip leads to the noted wear of the surface runway in the region of the overflow recesses; this wear can amount to one half to one millimeter in 10 to 20 hours, and can lead to rapid unserviceability of the machine. Tests of 100-hour duration could not be completed with such compressors.

Such an effect cannot occur in the side parts of the housing with an axial arrangement of the overflow recesses or grooves as illustrated in German Offenlegungsschrift No. 27 00 731, corresponding to U.S. Pat. No. 4,150,926—Eiermann dated Apr. 24, 1979, since the recess gas can escape laterally toward the overflow recesses. A disadvantageous effect, however, with this arrangement is that, as seen in the axial direction, the piston flank approaching the overflow recesses is at a very acute angle with respect to the surface runway or path. Only a very small cross section is available for the transfer of the gas into the preceding chamber upon entry into the lateral overflow recesses. The desired relief or pressure release of the residue pressure in the chamber which traverses or passes over the dead center position therefore does not occur quickly enough to effect a smooth or quiet running of the compressor, and to effect the greatest possible saving of power. Although this cross sectional constriction or narrowing-down would not be disadvantageous with the first mentioned radial arrangement of the overflow recesses, the described wear of the surface runway or path, and the unacceptable non-quiet running and greater consumption of power caused thereby, mandates axial arrangement of the overflow recesses.

It is an object of the present invention to improve the flow rate through the axial overflow recesses.

This object, and other objects and advantages of the present invention, will appear more clearly from the following specification in connection with the accompanying drawings.

SUMMARY OF THE INVENTION

Figure 1:
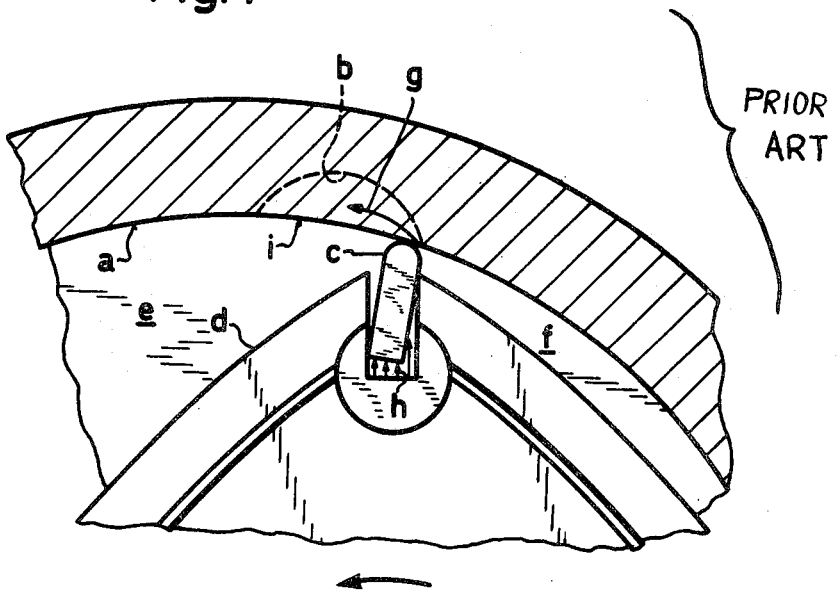
FIG. 1 is a partial radial section through a compressor according to the state of the art.

The compressor of the present invention is characterized primarily in that the leading corners of each of the three flanks or sides of the piston are sloped or bevelled radially inwardly and towards the grooves of the radial sealing strips.

According to a further specific embodiment of the present invention, the leading corners of each of the three flanks or sides of the piston are cut off or truncated in planes which intersect in a straight line which is located in the radial central plane of the piston externally of the piston, and at right angles to a straight line which extends in the radial central plane of the piston through the axis of rotation of the piston and through the sealing strip, which passes through the planes.

The spaces or chambers created by the slant or bevel of the flank corners make possible a sufficient and smooth flow beginning with approach of the lateral overflow recesses.

Referring now to the drawings in detail, there is first considered the already described effect with the arrangement according to the state of the art.

DETAILED DESCRIPTION

FIG. 1 shows the surface runway or path "a" with the overflow channel "b", which is just being approached by the radial sealing strip "c" of the piston "d". An overpressure prevails in the following working chamber "e" relative to the preceding chamber "f". Accordingly, the gas flows in the direction of arrow "g" from the working chamber "e" to the working chamber "f" through the overflow channel "b∞. As a result of the pressure relief in the chamber "f" and the released groove gas pressure, represented by arrows in the drawing, the sealing strip "c" tilts as illustrated, in so doing, however trapping in the piston grooves "h" therebelow the gas which is still under the previous pressure in the working chamber "e". The pressure of the groove gas is now considerably higher than that of the gas being relieved and flowing at great speed above about the sealing strip "c". The pressure therefore beats the sealing strip "c" accompanied by considerable noise development, against the path "a" and the webs "i" of the overflow channel in such a way that material deformations and wear occur which completely destroy the path "a" within a short time.

Figure 2:
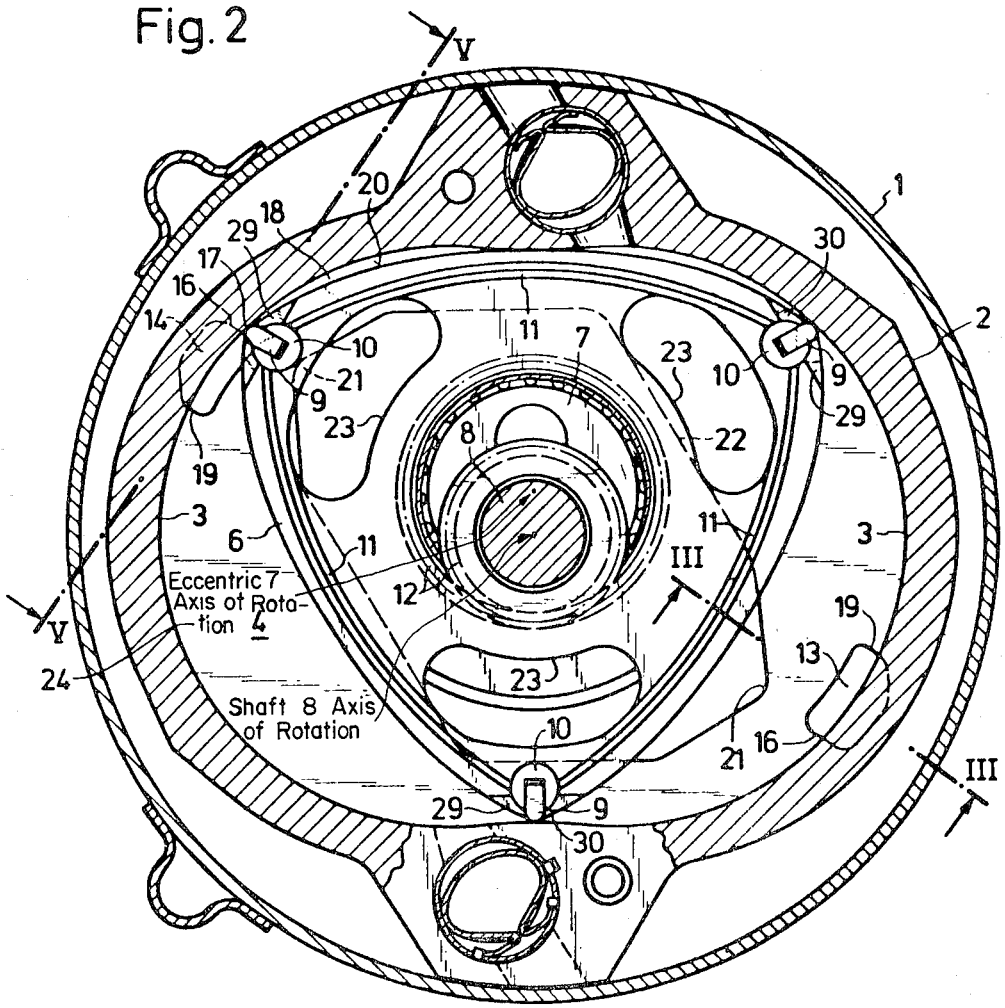
FIG. 2 is a radial section taken through one embodiment of a compressor according to the present invention.
Figure 3:
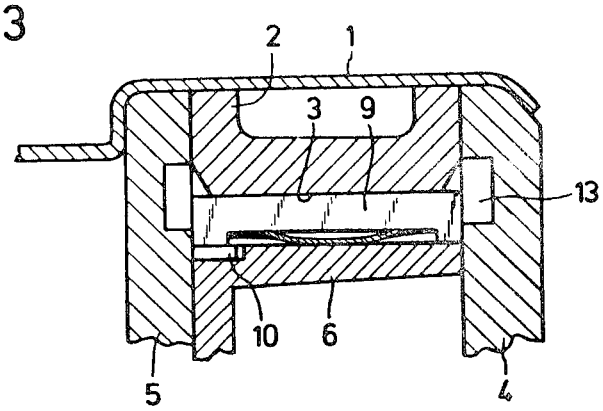
FIG. 3 is a partial axial section taken through the compressor according to FIG. 2 along line III—III in FIG. 2.

FIG. 2 illustrates a rotary piston compressor which comprises an enclosed housing 1, a housing sleeve or casing 2 having a trochoidal surface runway or path 3, a first side part 4, and a second side part 5. A piston 6 rotates upon a shaft 8 which has an eccentric 7 and passes through the side parts 4 and 5. The corners of the piston 6 are provided with radial sealing strips 9 and seal pins or stays 10; the sides of the piston are also provided with sealing strips 11. With the radial sealing strip 9, the piston is in continuous engagement with the runway 3. The movement of the piston 6 is controlled by a gearing 12 (FIG. 2). Two pocket-shaped overflow or transfer recesses 13 and 14 are provided in the side part 4 and in the side part 5 (visible in FIG. 2), the overflow recesses 13 and 14, when viewed in the direction of rotation of the piston, being respectively located after the dead center position and approximately at the beginning of the second third of the respectively following arc of the runway 3. Approximately half of the radial dimension of these recesses 13 and 14, as shown in FIG. 2, extends radially outwardly beyond the runway 3. The position or location of these overflow recesses 13 and 14 is determined in the following manner: the front control edge 16 of these recesses, as viewed in the direction of rotation of the piston 6, lies directly ahead of the preceding piston corner 17 of the chamber 18 created in the dead center position as apparent from FIG. 2. The position of the rear control edge 19 of the recesses 13 and 14, as viewed in the direction of rotation of the piston 6, is determined by the same piston corner in that position of the piston 6 in which its edge 20 approaches the inlet opening 21 for the aforementioned chamber 18, which in so doing becomes the intake chamber. The inlet openings with the compressor illustrated in FIG. 2 are located at the corners of the pocket-shaped recess 22 in the side part 4, and via the openings or break-throughs 23 in the piston 6 are supplied with working medium which enters through the other side part 5.

The described position of the front control edge 16 of the overflow recesses 13 and 14 results from the piston position at that point in time in which the pressure in the chamber 18 effecting the negative torque exceeds the overall frictional resistances of the machine, i.e., shortly after rotation of the piston through the dead center position. It is necessary to block, isolate or in effect close off the recesses 13 and 14 at the latest when the inlet opening of the following chamber 18 is approached or opened because if the recesses 13 and 14 continued to stay open, the leading or preceding compression chamber 24 would be connected with this inlet opening 21.

Figure 4:
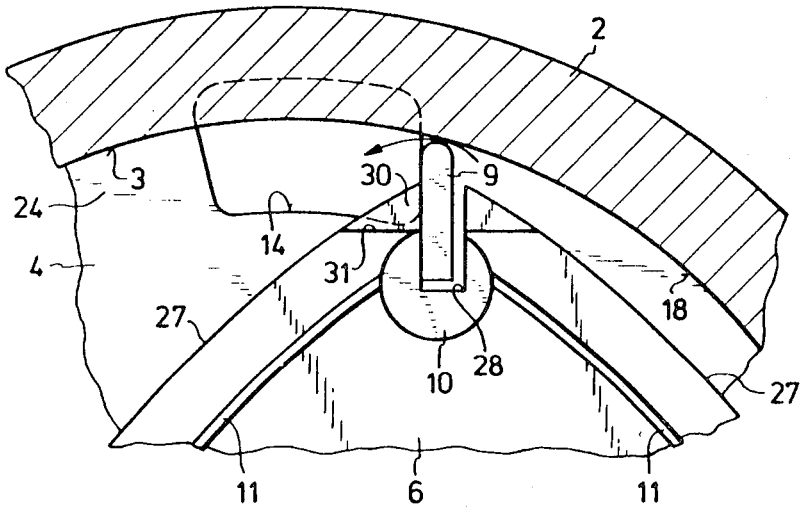
FIG. 4 is a cutaway portion of the structure of FIG. 2.
Figure 5:
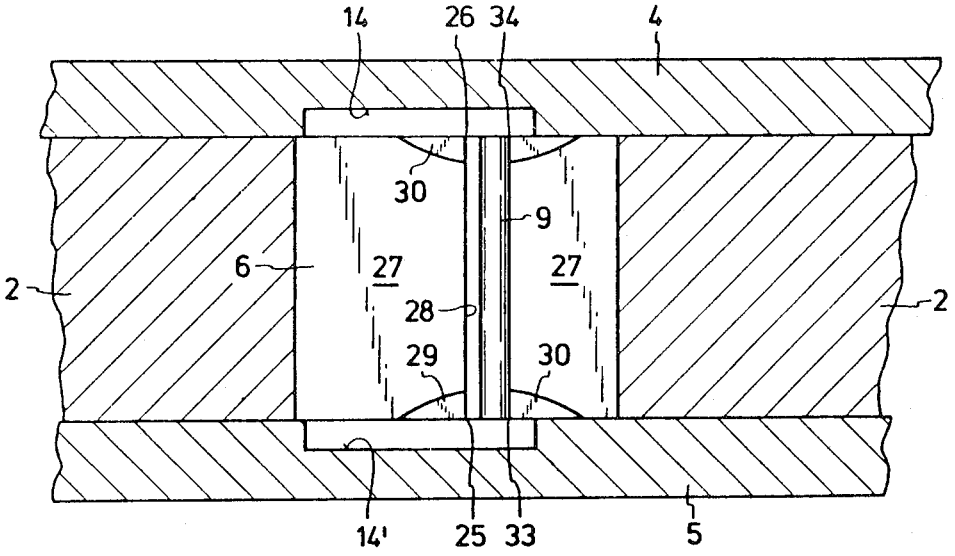
FIG. 5 is a partial segmental section taken along line V—V in FIG. 2.
Figure 6:
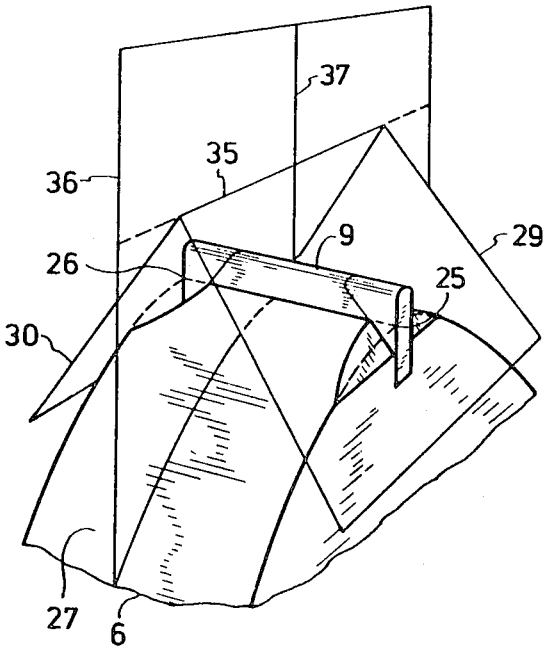
FIG. 6 is a perspective illustration of the position of the intersecting planes of the flank or side corners of the piston.

As shown in FIGS. 4–6, the leading corners 25 and 26 of each of the three flanks or sides 27 of the piston 6 are bevelled radially inwardly in the planes 29 and 30 and toward the grooves 28 of the radial sealing strips 9. The radially inner limit or boundary 31, 32 of these surfaces, when a given radial sealing strip moves over or traverses one of the overflow recesses 13, 14, coincides essentially with the radially inner limit or boundary of these overflow recesses 13 and 14. This limit or boundary itself cannot be permitted to lie radially within the inner end of the sealing strips 9 to prevent dropping thereof into the overflow recesses 13, 14. The bevels or chamfers in the planes 29 and 30 are expediently provided over the entire corner of the piston 6, for example by milling or cutting through the entire piston corner, so that these levels or chamfers also result at the following or trailing corners 33, 34 of the flanks or sides 27 of the piston 6. However, these trailing bevels or chamfers have no meaning for the function of the compressor beyond this fabrication expediency. The dead chambers resulting from the bevels, with their slight expansion, likewise have no meaning for the drive through-put and the power required of the machine.

The position of the planes 29 and 30 is schematically illustrated in FIG. 6. The planes 29 and 30 intersect each other in a straight line 35 which lies in the radial central plane 36 of the piston 6, externally of this piston, and at right angles to a straight line 37 which extends in the radial central plane 36 through the axis of rotation of the piston and the sealing strip 9, which passes through the planes 29 and 30.

Figure 7:
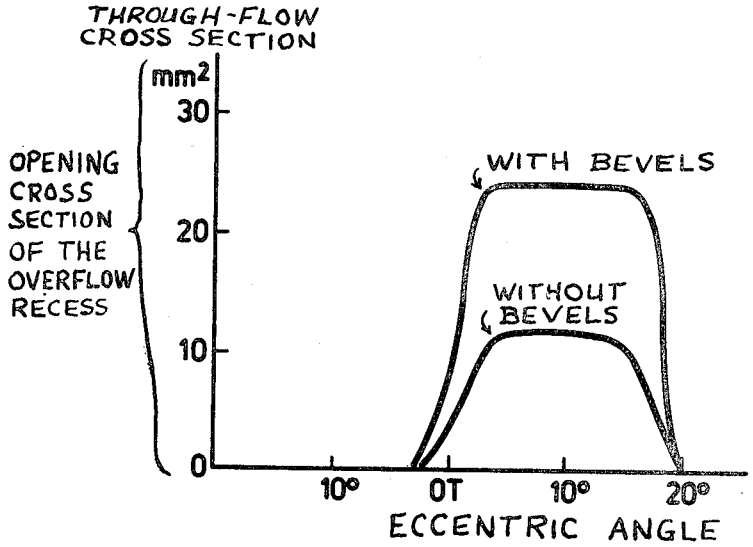
FIG. 7 is a graph which illustrates the inventive improvement by plotting the opening cross sections of the overflow recesses or grooves against the eccentric angle.

The flow path via the overflow recesses 13 and 14, which flow path is expanded by the chamfers or bevels in the planes 29 and 30, is now completely sufficient to attain a completely smooth or quiet running of the compressor, even at high speeds, and to attain the desired reduction of the power. The expansion of the flow path is represented in the graph of FIG. 7, whereby the eccentric angle is indicated along the ordinate, and the cross sectional area of the flow path is shown in $mm^2$ on the abscissa. The lower line shows the cross section without the inventive bevels, and the upper line shows the cross section with the bevels or chamfers according to the present invention.

As shown by tests, the desired smooth or quiet operation, unburdened by flow resistances during discharge or pushing-out of the residue pressure in the already closed-off compression chamber, is only possible with the aid of the arrangement and features of the present invention.

The present invention is, of course, in no way restricted to the specific disclosure of the specification and drawings, but also encompasses any modifications within the scope of the appended claims.

What I claim is:

1. In a rotary piston compressor, including:

a housing;

a casing arranged in said housing and having an inwardly directed, dual-arc trochoidal runway;

a shaft mounted in said housing and provided with an eccentric; and a piston rotating on said eccentric, said piston having three corners and three flanks, each corner being provided with a groove which respectively contains a sealing strip, said sealing strips being in continuous contact with said runway of said casing; said piston, in the upper dead center position, forming a compression chamber ahead of a given piston corner, when viewed in the direction of rotation of said piston, and forming a working chamber behind said last-mentioned piston corner; transfer recesses being provided in said housing for establishing a brief communication between an already closed-off trailing working chamber and a leading compression chamber; the improvement in combination therewith comprising two leading edges of each piston flank at each piston corner being bevelled radially inwardly and toward said groove of said piston corner respectively containing said sealing strip.

2. A rotary piston compressor in combination according to claim 1, in which said two bevelled leading edges of a given piston flank respectively form surfaces which lie in planes which intersect in a straight line which is located radially outwardly of said piston, and in the radial central plane of said piston, said straight line of intersection furthermore extending at right angles to a further straight line which extends in said radial central plane of said piston, through the axis of rotation of said piston, and through the associated sealing strip, the latter passing through said planes in which said bevelled leading edges are located.

* * * * *